US010011966B1

(12) United States Patent
Shaw

(10) Patent No.: US 10,011,966 B1
(45) Date of Patent: Jul. 3, 2018

(54) CABLED FLEXIBLE WALL DAM

(71) Applicant: Clifford Chung Chen Shaw, Fairfax County, VA (US)

(72) Inventor: Clifford Chung Chen Shaw, Fairfax County, VA (US)

( * ) Notice: Subject to any disclaimer, the term of this patent is extended or adjusted under 35 U.S.C. 154(b) by 0 days.

(21) Appl. No.: 15/731,617

(22) Filed: Jul. 10, 2017

(51) Int. Cl.
*E02B 7/00* (2006.01)
*E02B 3/10* (2006.01)

(52) U.S. Cl.
CPC ..... *E02B 7/005* (2013.01); *E02B 3/10* (2013.01)

(58) Field of Classification Search
CPC combination set(s) only.
See application file for complete search history.

(56) References Cited

U.S. PATENT DOCUMENTS 2,609,666 A * 9/1952 Mesnager ..... B65D 88/02 405/115
3,213,628 A * 10/1965 Serota ..... E02B 3/108 220/62.21
4,102,134 A * 7/1978 Margen ..... E02B 3/00 114/293
4,310,262 A * 1/1982 Calza ..... E02B 7/005 405/115
4,906,134 A * 3/1990 Hoyeck ..... E02B 7/005 405/107
8,251,612 B2 * 8/2012 Hartman ..... E02B 3/102 405/64
8,928,480 B2 * 1/2015 Iffergan ..... B63G 9/04 340/501
2005/0163570 A1 * 7/2005 Cullen ..... E02B 7/005 405/87

* cited by examiner

*Primary Examiner* — Kyle Armstrong

(57) ABSTRACT

A cabled, non-inflatable type flexible wall dam for restraining or controlling the flow of water is disclosed. The cables and flexible wall of present invention are arranged in a manner that enables present flexible wall dams to open (lower) and close (raise) for controlling the flow of water. Present invention includes a reinforcement method that has a net like reinforcement layer and reinforcement cables, and therefore the dams of present invention can be built to be stronger, larger, and higher than the most commonly used inflatable flexible wall dams.

8 Claims, 8 Drawing Sheets

U-U' SECTION

W-W' SECTION

W-W' SECTION

SECTION V-V'

CABLED FLEXIBLE WALL DAM

FIELD OF THE INVENTION

Present invention relates to a cabled non-inflatable type flexible wall dam. It deals with the structure, operation, and the reinforcement methods for a flexible wall dam.

BACKGROUND OF THE INVENTION

There are more than four thousand flexible dams in the world. Most of them are of the air or water bag types. They can be "opened" (deflated, or collapsed) during rainy seasons, and have numerous advantages over solid dams due to low capital cost, versatility in application, and less impact on environment. However, they have a big disadvantage, they can only be built as low-head dams. Almost all of the current flexible dams are shorter than 5 meters high, beyond which, it becomes impractical, uneconomical and gradually impossible.

One of the objectives of present invention is to provide a new concept for constructing a higher and larger flexible wall dam.

There were several attempts to build a collapsible and more economical flexible wall dam by using non-inflatable type structure, but they had shortcomings, such as:

U.S. Pat. No. 4,906,134 issued to Hoyeck described a flexible wall dam destined to open and close the flow of water, which consisting of an upstanding flexible wall having a common supporting cable above the top edge of the dam, and having solid, telescopic anchoring ties with solid spacers, and having its common supporting cable being extendable for pulling in or releasing, thereby enable this flexible wall dam to open or close the flexible wall for controlling the flow of water. It is noticed that said common supporting cable generally is heavily stressed and sustains the major pulling forces alone the top portion of the flexible wall dam, so the extendable moving mechanisms have to be strong and costly, and said solid telescopic ties and spacers are complicated in construction and operation. All of those issues make this dam expensive to build, maintain, and operate. That is why it is only good for a small dam.

Present invention will provide a new "opening" and "closing" operational methods for a non-inflatable type collapsible flexible wall dam, without extending or retracting the heavily stressed common supporting cable, and without the complexity of the solid tie and spacer elements.

In U.S. Pat. No. 4,906,134 issued to Hoyeck, U.S. Pat. No. 4,647,250 issued to Howard, and U.S. Pat. No. 495,788 issued to L. Debarle, they provided a technique to strengthen a flexible wall dam by connecting multiple reinforcing cables to multiple reinforced joint points on the upstream side of the flexible wall, and anchored to the waterbed of the dam. It is noticed that for a loaded dam, those reinforced joint points and reinforcing cables located on the upstream side of said flexible wall will be submerged into water and will be heavily stressed, so they need more maintenance efforts. Having reinforced joint points and anchors in the water will be a costly arrangement for a flexible wall dam.

Present invention will provide three methods to solve above problems by disposing all the heavily stressed cables and the complicated joints on the dry (downstream) side of the dam. Said methods will greatly reinforce the strength of the flexible wall dam, provide a strong outer "skin" for penetration protection, and avoid dealing with the troublesome water when performing the maintenance works on the reinforcement elements. This will also make it possible to build a stronger, higher, and larger collapsible flexible wall dam and will be economically feasible.

Furthermore, the reinforcement methods provided in this invention are so versatile that they can be applied to both the collapsible and non-collapsible flexible wall dams.

BRIEF SUMMARY OF THE INVENTION

Present invention relates to a flexible wall dam assembly for restraining or controlling the flow of water. Said dam can be constructed on the waterbed or on the top of a solid dam, comprising in combination:

a strong flexible sealing wall disposed on a waterbed, or on the top of a solid dam, said sealing wall having upper, lower and side edges, means for sealingly securing said lower edge to said waterbed (or the top of a solid dam) and sealingly securing said side edges to the banks of said water, said upper edge being secured along a top cable, said top cable and said sealing wall being specially arranged in such a manner that enables present flexible wall dam to perform the actions of closing (raising) and opening (lowering) for controlling the flow of water, a reinforcement layer and reinforcement cables may be added and disposed on the downstream side of said sealing wall, resulting in a stronger, larger and higher flexible wall dam, means to raise (close) or lower (open) said flexible sealing wall, reinforcement layer and reinforcement cables.

BRIEF DESCRIPTION OF DRAWINGS

All drawings provided here in this literature are somewhat schematic and wherein the like reference characters like parts in all FIGs, views and drawings.

DETAILED DESCRIPTION OF PREFERRED EMBODIMENTS

Figure 1:
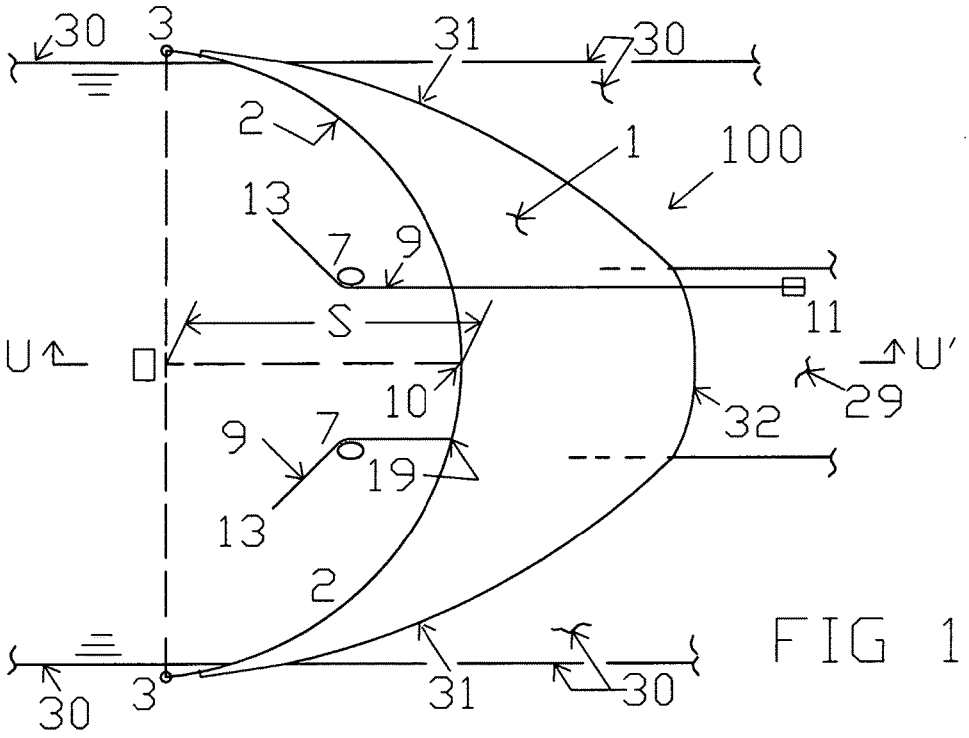
FIG. 1 shows the top view of a collapsible flexible wall dam 100, the first preferred embodiment of present invention.
Figure 2:
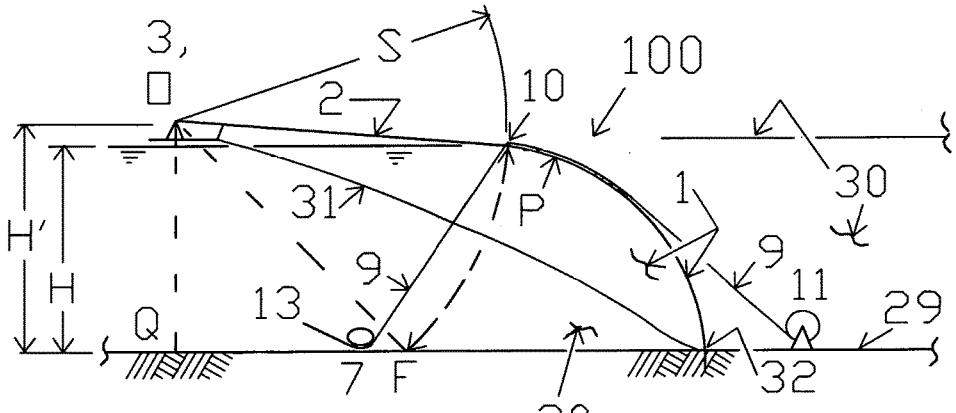
FIG. 2 shows the U-U' cross-section view of FIG. 1.
Figure 3:
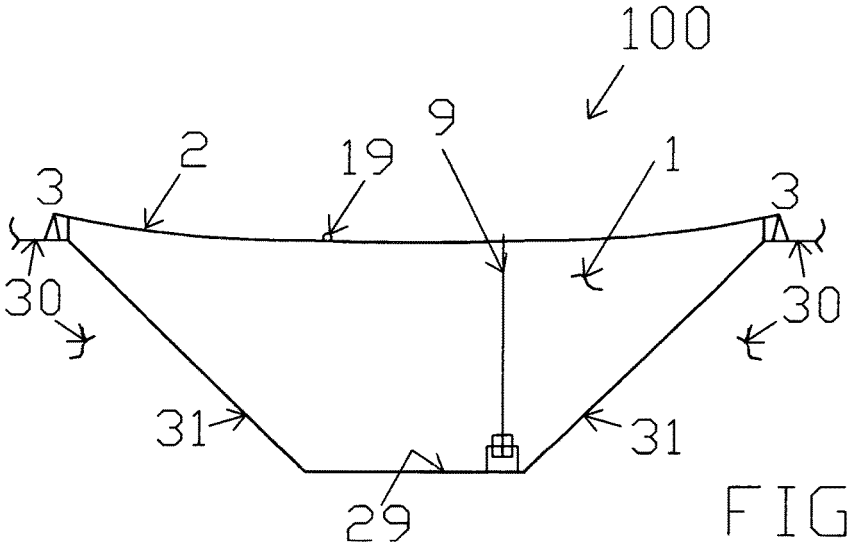
FIG. 3 shows the front view of FIG. 1 (view from U' in FIG. 1 facing the dam).

FIGS. 1 to 3 are the three views of the first preferred embodiment of present invention those show a fully loaded collapsible flexible wall dam in an up standing position. This flexible wall dam 100 is disposed on a waterbed 29 which has an inclined up bank 30*s*. It consists of a strong, impermeable flexible sealing wall 1, and a top cable 2 shaped into a large arc (see FIG. 1). Top cable 2 is disposed substantially horizontal across said water, and has both ends mounted by top anchor 3*s* on the top of bank 30*s* on the upstream side of said sealing wall 1. Said flexible wall dam has an apex point 10 which is also the mid-point of said top cable 2 when said dam 100 has the highest water level. Top anchor 3*s* are positioned at a level slightly higher than apex point 10. Sealing wall 1 has upper, lower, and side edges, and has the means for substantially sealingly securing said lower edge 32 to the waterbed 29, and sealingly securing side edge 31*s* to bank 30*s*. The upper edge is attached to top cable 2. The sealing wall 1 is suitable sized to have slack that allows said top cable 2 and sealing wall 1 to raise or lower when said dam is in operation (will explain later). Referring to top view FIG. 1, the lower and side edges of said sealing wall 1 preferably forms a curve, the center section of the lower edge 32 of sealing wall 1 has a suitable distant from the center section of top cable 2, and have both side edge 31*s* gradually curved towards top anchor 3*s*. When filled with water, sealing wall 1 will bloat due to the nature of water pressure and create an upward component force P on the top portion of sealing wall 1 (see FIG. 2), thus enabling this flexible wall dam 100 to stand by itself. Conventional sediment release gates and/or water gates (not shown) may be installed on the bottom of the dam, especially when said dam was built on the top of a solid dam.

Referring to FIGS. 1 and 2, defining the dotted line between two anchor 3*s* as chord, and the mid chord point O (it is the same point as anchor 3 in side view as shown in FIG. 2) to apex 10 as sagitta S, this sagitta S has a substantial length. When in operation, the entire top cable 2 will slowly "pivot" (or bend) around top anchors 3*s*. In FIG. 2, theoretically the center section of said top cable (represented by apex point 10) will move up or down along the curved path between points 10 and F, as shown by the dotted line between the two points, and using said sagitta S as a radius. Thereby, enables the center section (10) of said top cable and the upper edge of said sealing wall being lowered or raised with a substantial length, called the adjustable height H. It is the vertical displacement of apex from points F (or Q, represents the water level when dam 100 has been lowered) to the level of 10 (represents the highest water level). The lengths of said adjustable height H and sagitta S, and their relations can be derived by using a geometric method that will be described in the next paragraphs.

Referring to FIG. 2, in order to properly perform the actions of lowering (opening) and raising (closing) for this non-inflatable type flexible wall dam with a substantial adjustable height H, the top cable 2 shall be arranged in such a manner that the length of said sagitta S shall be substantial, and be suitably longer than H (see next paragraph). Geometrically, a ratio of roughly 1.4 may considered as adequate.

Referring to FIG. 2, O-Q-F forms a right triangle, the incline dotted line O-F is longer than vertical dotted line O-Q. Since O-F equal to S, and O-Q equal to H', thus S is longer than H'. Since H' is longer than H, thus S is longer than H.

Figure 4:
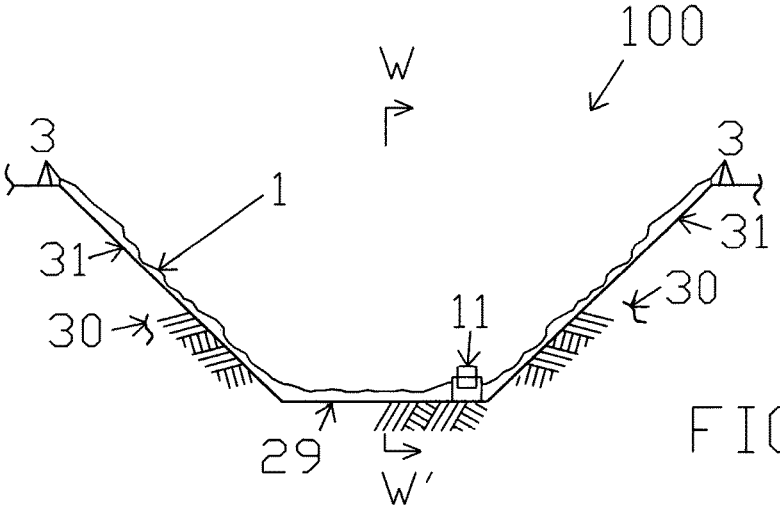
FIG. 4 shows the front view of FIG. 1 (view the same way as FIG. 3) while the flexible wall dam 100 was lowered (opened).
Figure 5:
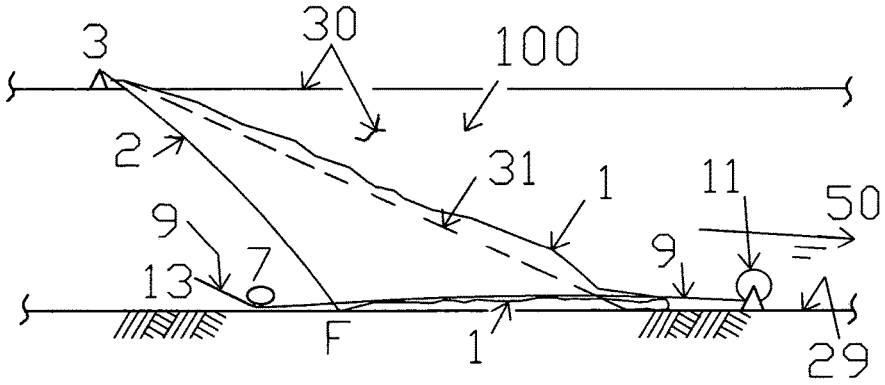
FIG. 5 shows the W-W' cross-section view of FIG. 4.

To open the flexible wall dam 100, the water gates (if equipped) are opened, lifting cables 24*s* (see FIGS. 7 to 10) are released, and the lowering cable 9*s* are pulled by a winching mechanism connected to cable end 13*s* (see FIGS. 1 and 2), threaded through a low-friction guiding device (such as a plastic pulley) 7*s* positioned at a level not higher than the lower water level (point F), routed up and over the top cable 2 and the outer layer of sealing wall 1, then down to a pulling means (an anchor or another winching means) 11 on the waterbed 29, and on the downstream side of said sealing wall 1, forcing top cable 2 and upper edge of the sealing wall 1 to move down, causing top cable 2 to "pivot" (or bend) around top anchor 3*s*, and the center section (10) of top cable 2 to be lowered down (to point F), allowing water to escape over top cable 2 and sealing wall 1, gradually making whole flexible wall dam 100 to collapse onto waterbed 29 (see FIGS. 4 and 5). The waterway is then cleared to allow water 50 to flow over the collapsed flexible wall dam 100 as shown in FIG. 5.

Alternatively, said lowering cable 9 can be tied at point 19 (shown in FIGS. 1 and 3) on the center section of top cable 2, to pull top cable 2 down.

If the flexible wall dam 100 is built on the top of a solid dam, the guiding device 7*s* and pulling means 11 can be positioned lower than the lower edge 32 of said sealing wall 1. This arrangement will improve the operation of lowering, and holding down said top cable and sealing wall.

To raise the flexible wall dam 100, the water gates (if equipped) are closed, lowering cable 9*s* are released, and two lifting cable 24*s* are pulled (see FIGS. 7 to 10). They are pulled with an upward component at an angle not in the direction of the water thrust, so lifting means and cable 24*s* can be made less costly. As long as top cable 2 is lifted above water level, the water pressure will create an upward component force P and push into sealing wall 1, which will make whole dam 100 to stand up as shown in FIG. 2.

It is noticed that the dam 100 can perform the actions of opening (lowering) and closing (raising) without extending or retracting the heavily stressed top cable 2 (equivalent to a common cable). This invention should make it more reliable and cost effective for a collapsible flexible wall dam, compare to the prior inventions as mentioned above.

For constructing a larger and/or higher flexible wall dam, including both the collapsible and non-collapsible type dams, a dam can be reinforced using methods described in the following paragraphs.

Figure 6:
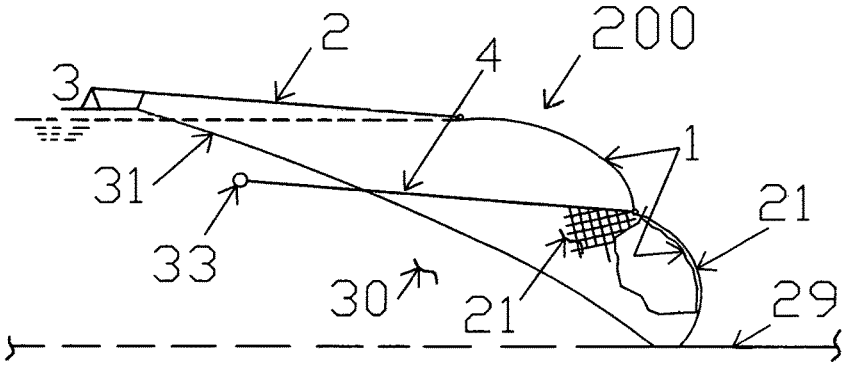
FIG. 6 shows the side view of flexible wall dam 200, the second embodiment of present invention, which has a reinforcement layer 21 disposed on the lower portion of the dam.

Shown in FIG. 6, the flexible wall dam 200 is partially reinforced with a strong, generally permeable fiber canvas, or a net like reinforcement layer 21 on the weak, or heavily stressed areas, especially around the lower portion of sealing wall 1 on the downstream side. Said reinforcement layer 21 has upper, side and lower edges, and has means for at least securing its upper edge to a reinforcement upper cable 4, and securing its lower edge to waterbed 29. The upper reinforcement cable 4 generally is horizontally extended and anchored both ends to side anchoring means 33*s* on the banks, and has positioning means for at least partially attached on said sealing wall 1. Sealing wall 1 preferably is loosely disposed in the areas having contact with reinforcement layer 2, thereby ensuring the water pressure will be transferred to reinforcement layer 21.

Figure 7:
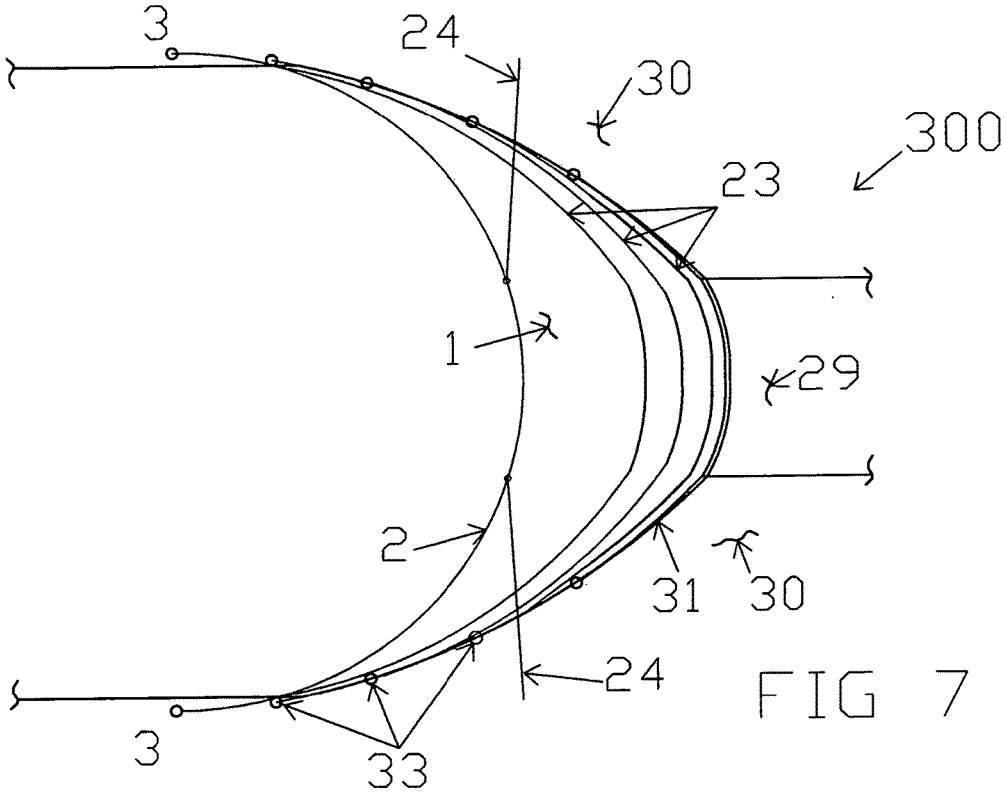
FIG. 7 shows the top view of flexible wall dam 300, the third embodiment of present invention, which has horizontal reinforcement cable 23*s* on its body.
Figure 8:
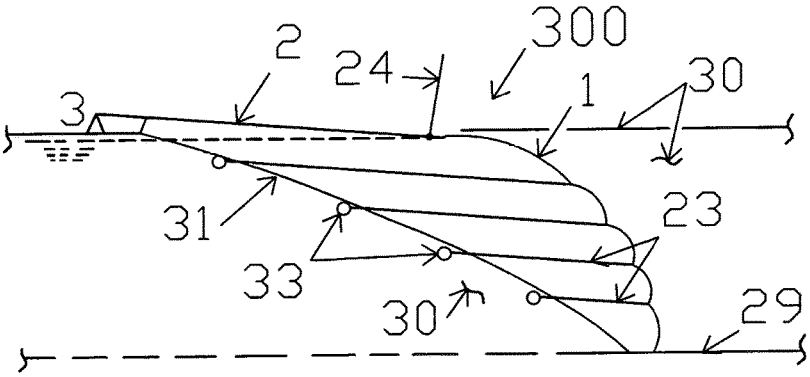
FIG. 8 is the side view of FIG. 7.
Figure 9:
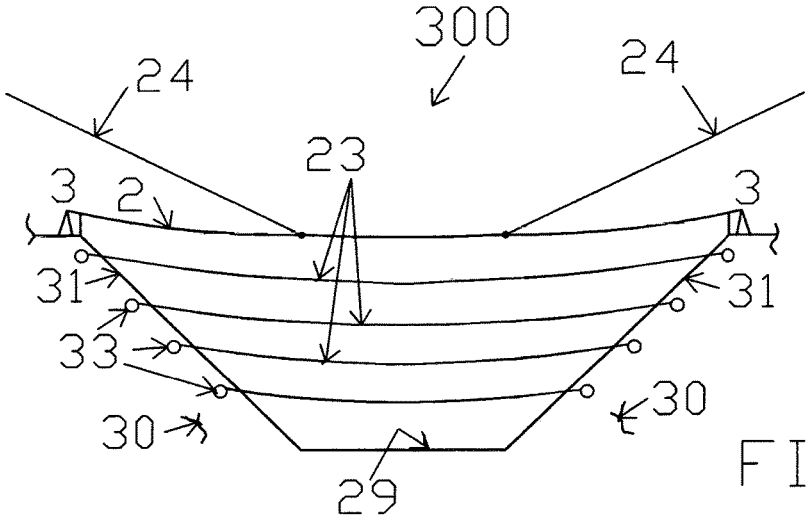
FIG. 9 is the front view of FIG. 7.

FIGS. 7, 8 and 9 show another preferred embodiment of present invention with another reinforcement method of having horizontal cables to reinforce flexible dam 300. In addition to the primary elements of sealing wall 1 and top cable 2, additional horizontal reinforcement cables 23*s* are disposed between the top and the lower edge of sealing wall 1 on the downstream side, and at least partially attached with sealing wall 1 for positioning. The center sections of the reinforcement cable 23*s* are generally parallel with each other, and with the top edge of said sealing wall, and each cable has both ends attached to side anchoring mean 33*s* on bank 30*s*. In the case of a collapsible flexible wall dam, the curvature of said reinforcement cable 23*s* will be like top cable 2, each reinforcement cable 23 has its own sagitta S but each with a different length, and each uses its own side anchoring means 33*s* as the pivot points, and the center section of each reinforcement cable can be laid and arrayed on the waterbed (see FIG. 10) when dam 300 was lowered (opened). In some cases, multiple vertical reinforcement cables, such as element 25*s* shown in FIGS. 13 and 14 may be added. If provided, said vertical reinforcement cable 25*s* must be more flexible than horizontal reinforcement cable 23*s*.

Figure 10:
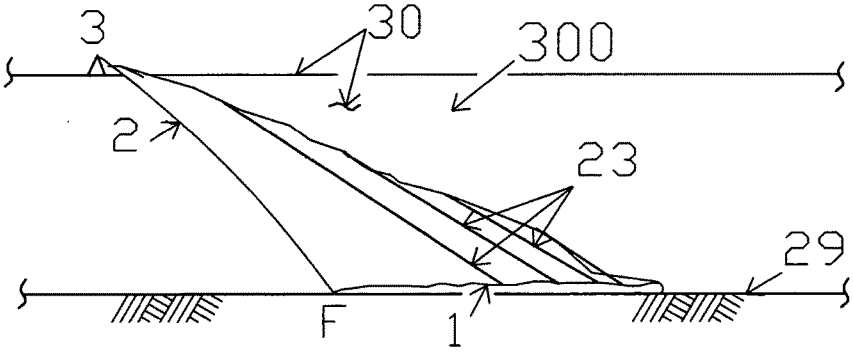
FIG. 10 is the cross-sectional side view of FIG. 8 while the flexible dam 300 is lowered.

FIG. 10 shows a collapsed dam 300 (raising and lowering devices not shown). It is a cross-sectional view and viewed on the same way as dam 100 shown in FIG. 5. It clearly shows how the cable 2, 23*s* and sealing wall 1 are laid on the waterbed 29 and water bank 30 when said dam was collapsed.

Figure 11:
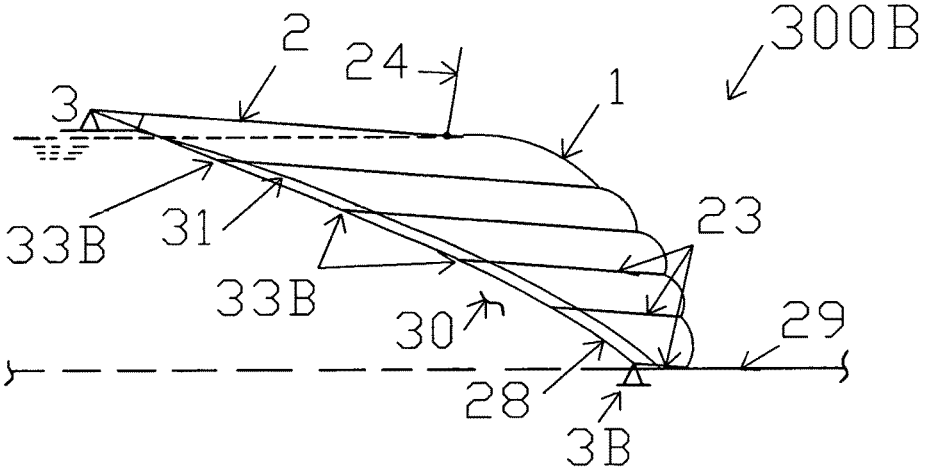
FIG. 11 shows a side view of flexible wall dam 300B, which use two side cable 28*s* for anchoring all of the reinforcement cable 23*s*.

FIG. 11 is a side view of dam 300B. It shows another concept of anchoring reinforcement cable 23*s*. This dam is a modification of dam 300. In addition to the similar elements of sealing wall 1, top cable 2, two top anchor 3*s*, five reinforcement cable 23*s*, the dam 300B has two extra side cable 28*s* disposed by the side edge 31*s* of said sealing wall 1. The upper ends of said side cable 28*s* are attached to top anchor 3*s*, and the lower ends are attached to base anchor 3Bs. All the reinforcement cable 23*s* are attached to joining means 33Bs onto side cable 28*s* at the position equivalent to side anchoring means 33*s* in dam 300. Dam 300B has the advantage to reduce the number of side anchoring means required which in turn may reduce the cost.

Figure 12:
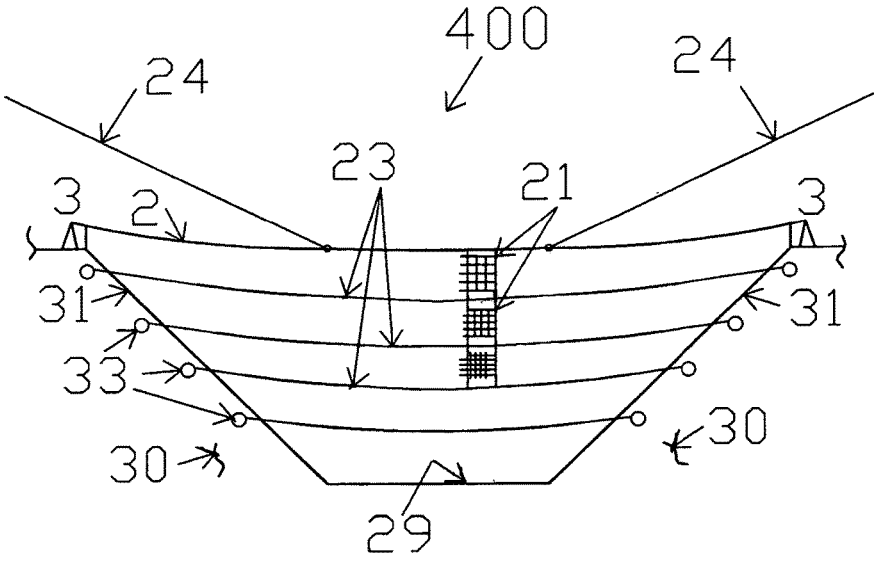
FIG. 12 shows a front view of flexible wall dam 400, the fourth embodiment of present invention, which has a reinforcement layer and reinforcement cables disposed on its body.

The dam 400 showing in FIG. 12 is a combination of dams 100, 200, and 300, designed for a higher, larger, and stronger dam. Dam 400 is reinforced with both reinforcement layer 21 and reinforcement cable 23*s*. It is shown in FIG. 12 that the canvas or net on reinforcement wall 21 is weaved more densely as you move down the wall to provide a stronger support, since the water pressure is much higher on the lower level. Reinforcing layer 21 is disposed on the downstream side of sealing wall 1, and having its top edge attached to top cable 2. Reinforcement cable 23*s* are disposed on the downstream side of reinforcement layer 21.

Figure 13:
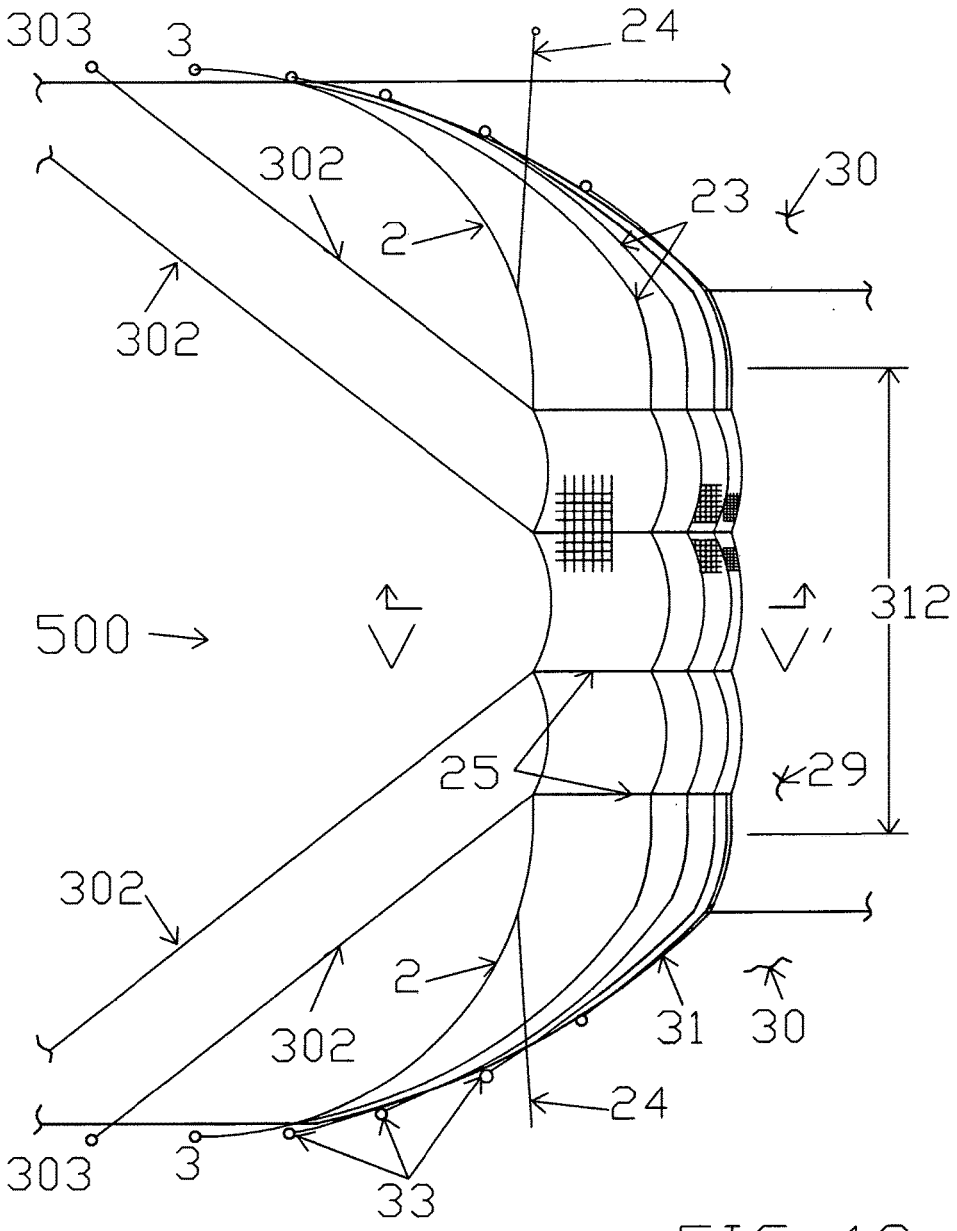
FIG. 13 shows the top view of a wider flexible wall dam 500, the fifth embodiment of present invention.
Figure 15:
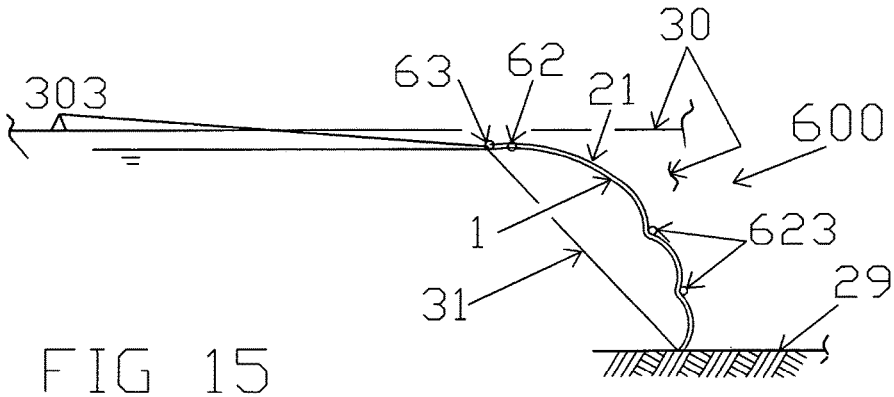
FIG. 15 shows the V-V' cross-section view of FIG. 14.

FIG. 13 shows a top view of another embodiment of present invention. The collapsible flexible wall dam 500 is built on a wide river. It uses the principle as described in the previous embodiments and has similar major elements: top cable 2 and flexible wall 1. The major change is the center section 312 of the dam, which has been lengthened and is supported by intermediate cable 302*s*, which is pointing to upstream and sideward, having a suitable length and having one end attached to upper anchor 303*s* those are located further upstream on the bank, and the other end attached to a suitable place on center section 312 of said top cable 2, to sustain the water pressure against the center section of the dam. Generally, reinforcement cable 23*s* and reinforcement layer 21 are also adopted with extra vertical reinforcement cable 25*s*. The cross section view V-V' of the flexible wall along the center line of the dam will look like the sealing wall 1 and reinforcement layer 21 shown in FIG. 15. When performing the action of raising, or lowering, the intermediate cable 302*s* will slowly pivot from the ends attached to upper anchor 303*s* and move up, or down on the ends attached to top cable 2.

An alternative way of constructing a long collapsible flexible wall dam over a wide river is to have multiple posts or artificial islands installed between two water banks and any one dam of 100 to 400 of present invention to be constructed between them, having linked to become a long wall dam.

All the drawings shown above are the collapsible type flexible wall dams. The reinforcement methods of present invention can be perfectly applied to a non-collapsible type flexible wall dam as well.

Figure 14:
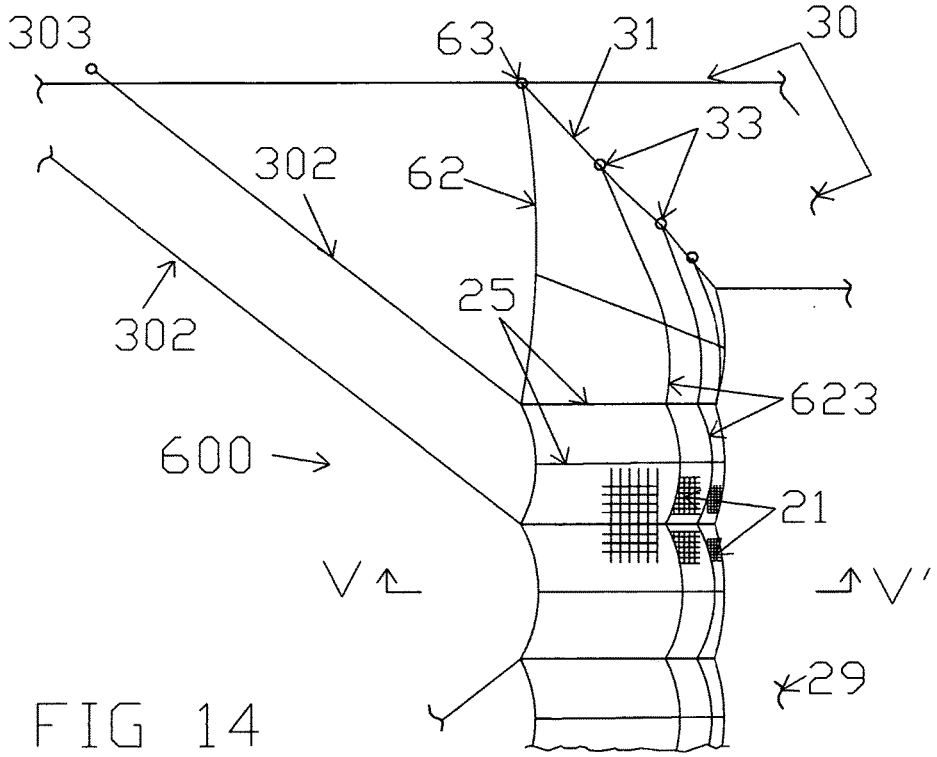
FIG. 14 is a top view of flexible wall dam 600, which shows how the reinforcement methods of present invention are applied on a non-collapsible flexible wall dam.

FIG. 14 is a top view of the flexible wall dam 600, showing how the reinforcing methods of present invention are applied on a non-collapsible flexible wall dam. Having a similar shaped of banks and waterbed as dam 500, the shape of the center section of dam 600 can be the same. Due to this dam not being collapsible, the top cable 62 does not form an arc and has little or no sagitta S. The sealing wall 1 and reinforcement layer 21 have less slack. Shown in FIG. 15 (also in FIG. 6), there is a gap between sealing wall 1 and reinforcement layer 21. However, this is only for illustration to show two separate layers. In reality, when loaded with water there will be no gap between them, just like an old style auto wheel tires, there is no gap between the outer and inner tires when it is pressurized. Generally, the horizontal reinforcement cable 623*s* are also installed, and some of them may have an angle with the ground. Multiple vertical cable 25*s* are added for further reinforcement. The structure of dam 600 is not collapsible, but has the advantage of having a simpler design with cable top 62 being straight, as oppose to top cable 2 having an arc shape. This can reduce the fabrication cost.

It should be noted that all of the heavily stressed cables, reinforcement layer, and anchoring means are located on the side without water. This avoids the complexity of dealing with water when performing maintenance and renovation, thus further reducing the cost of a flexible wall dam.

The advantages of applying reinforcement layer 21 are that the sealing wall 1 can be functioned mainly for sealing. It sustains much less tension or tearing force with the present of the reinforcement layer 21. Therefore, sealing wall can be made as large as possible. When the dam is filled with water the water pressure is first transferred from sealing wall 1 to reinforcement layer 21, then to reinforcement cable 23*s* and top cable 2, then to the anchors (3*s*, 33*s*, etc.), then finally to banks and waterbed. By having reinforcement layer 21, the bottom and side edge-sealing of sealing wall 1 can be simple. The edge-sealing can be sealingly secured by applying glue, or using weight-blocks, or the like.

The advantages of applying the reinforcement cable 23*s* includes: 1) the top cable 2 can be minimized (thinner), thus making it more flexible, since reinforcement cable 23*s* will eventually carry most of the water pressure, 2) the flexible wall dam can be built stronger, larger, and higher and 3) the lowering and raising mechanisms can be physically minimized.

Sealing wall 1 can be made with fabric having reinforced cross-weaved fiber, coated with soft material such as rubber, at least on the upstream side of said sealing wall. Reinforcement layer can be made with strong fiber (such as fiber glass), and can be meshed with fine stainless steel wires if necessary. For a thick or strong sealing wall, the mesh of reinforcement layer can be wider that resembles a net. Reinforcement layer and sealing wall can be made piece by piece, then stitched, glued, and rubberized together on work sites. The horizontal cables (2, 62, 23*s* and 623*s*) can be made with stainless or galvanized steel cables, if necessary. Although the steel cable may be a bit stiff, the bending stress on those cables would be mild during operation, since they are formed in a large arc. Major folding and bending will occur on the sealing wall 1 and reinforcement layer 21. Both of these two elements are quite flexible.

It is noticed that all of the reinforcement layer and reinforcement cables are placed on the downstream (outer) side of the sealing wall, which will provide an excellent protection against debris penetration for the sealing wall.

With the above characteristics, this results in a collapsible or non-collapsible flexible wall dam that is larger, higher and stronger, using existing techniques, also makes the dam economically feasible.

Although the present invention has been explained in relation to its preferred embodiments, it is understood that many other possible modifications and variations can be made without departing from the spirit and scope of the present invention as hereinafter claimed.

I claim:

1. A flexible wall dam assembly capable of being raised and lowered for controlling the flow of water, when filled with water said flexible wall dam assembly comprising in combination: a) a top cable shaped to an arc disposed substantially horizontal across said flow of water, having each end attached to a top anchor mounted on the banks of said flow of water and with the arc of said top cable facing downstream of said flow of water, said top anchors being positioned on a level slightly higher than the mid-point of said top cable, defining the points between said two top anchors as chord, which has a mid-chord point, the length from said mid-chord point to the mid-point of said top cable as sagitta S, said sagitta S has a length, thereby enabling the center section of said top cable to lower or raise with an adjustable height H, during the operation of said dam; b) an impermeable, flexible sealing wall disposed underneath said top cable, said sealing wall having upper, lower, and side edges, means for substantially sealingly securing said lower edge to the waterbed of said flow of water, sealingly securing said side edges to the banks of said flow of water, and attaching said upper edge underneath said top cable, said sealing wall having adequate slack to enable said top cable and said sealing wall to be raised and lowered during the operation of said dam; and c) at least one lowering cable, coming from a winching means and being threaded through a guiding device positioned close to said waterbed located on the upstream side of said sealing wall, routed up and tied at a point located on the center section of said top cable, in order to pull down said top cable and to collapse said sealing wall.

2. The flexible wall dam as defined in claim 1, further having at least one lifting cable attached to the center section of said top cable directed upward to the side at an angle, and when lifted said lifting cable will have an upward component, for raising said top cable and said sealing wall.

3. A flexible wall dam assembly capable of being raised and lowered for controlling the flow of water, when filled with water said flexible wall dam assembly comprising in combination: a) a top cable shaped to an arc disposed substantially horizontal across said flow of water, having each end attached to a top anchor mounted on the banks of said flow of water and with the arc of said top cable facing downstream of said flow of water, said top anchors being positioned on a level slightly higher than the mid-point of said top cable, defining the points between said two top anchors as chord, which has a mid-chord point, the length from said mid-chord point to the mid-point of said top cable as sagitta S, said sagitta S has a length, thereby enabling the center section of said top cable to lower or raise with an adjustable height H, during the operation of said dam; b) an impermeable, flexible sealing wall disposed underneath said top cable, said sealing wall having upper, lower, and side edges, means for substantially sealingly securing said lower edge to the waterbed of said flow of water, sealingly securing said side edges to the banks of said flow of water, and attaching said upper edge underneath said top cable, said sealing wall having adequate slack to enable said top cable and said sealing wall to be raised and lowered during the operation of said dam; and c) at least one lowering cable, coming from a pulling means and being threaded through a guiding device positioned close to said waterbed located on the upstream side of said sealing wall, routed up and over said top cable, and onto the outside layer of said sealing wall, then routed down to another pulling device positioned on said waterbed on the downstream side of said sealing wall, in order to pull down said top cable and to collapse said sealing wall.

4. The flexible wall dam as defined in claim 3, further having at least one lifting cable attached to the center section of said top cable directed upward to the side at an angle, and when lifted said lifting cable will have an upward component, for raising said top cable and said sealing wall.

5. A flexible wall dam assembly capable of being raised and lowered for controlling the flow of water, when filled with water said flexible wall dam assembly comprising in combination: a) a top cable shaped to an arc disposed substantially horizontal across said flow of water, having each end attached to a top anchor mounted on the banks of said flow of water and with the arc of said top cable facing downstream of said flow of water, said top anchors being positioned on a level slightly higher than the mid-point of said top cable, defining the points between said two top anchors as chord, which has a mid-chord point, the length from said mid-chord point to the mid-point of said top cable as sagitta S, said sagitta S has a length, thereby enabling the center section of said top cable to lower or raise with an adjustable height H, during the operation of said dam; b) an impermeable, flexible sealing wall disposed underneath said top cable, said sealing wall having upper, lower, and side edges, means for substantially sealingly securing said lower edge to the waterbed of said flow of water, sealingly securing said side edges to the banks of said flow of water, and attaching said upper edge underneath said top cable, said sealing wall having adequate slack to enable said top cable and said sealing wall to be raised and lowered during the operation of said dam; c) a flexible reinforcement layer disposed on the downstream side of said sealing wall, at least on the lower portion of the same, said reinforcement layer having upper, lower, and side edges, and having means for securing said lower edge to said waterbed and securing said upper edge to an upper reinforcement cable, both ends of said upper reinforcement cable being anchored to a side anchoring means on the banks of said flow of water, said upper reinforcement cable being disposed substantially parallel with said top cable, and having a positioning means for attaching to said sealing wall, said reinforcement layer having adequate slack to enable said top cable, said sealing wall, and said reinforcement layer to be raised and lowered during the operation of said dam; and d) having at least one reinforcement cable disposed on the downstream side of said reinforcement layer and between the upper and the lower edges of the same, said at least one reinforcement cable being substantially parallel with said top cable, and having a positioning means for attaching to said reinforcement layer, both ends of said at least one reinforcement cable being attached to a side anchoring means mounted on both banks of said flow of water, said at least one reinforcement cable being shaped to an arc in such a manner that enables said sealing wall, said reinforcement layer, and said at least one reinforcement cable to perform the raising and lowering actions during the operation of said dam.

6. The flexible wall dam as specified in claim 5 wherein each of said side anchoring means being substituted by a connecting means at one of the two side cables, said side cables being disposed along both side edges of said sealing wall, with each upper ends being attached to said top anchors, and each lower end being attached to a base anchor positioned closed to the waterbed of said flow of water.

7. The flexible wall dam as defined in claim 5, wherein the whole center section of said dam having width extension with at least one intermediate cable, with one end attached to the center section of said top cable, and the other end attached to an upper anchor on the upper level of said bank that is located further upstream from said top anchor, said at least one intermediate cable having a length that enables the end attached to said top cable to move with the center section of said top cable up or down during operation when raising or lowering said sealing wall to respectively close or open said dam.

8. A method of reinforcing a flexible wall dam, said dam has a layer of impermeable, flexible sealing wall, for restraining or controlling the flow of water, said method including: a) providing a top cable shaped to an arc disposed substantially horizontal across said flow of water, having each end attached to a top anchor mounted on the banks of said flow of water and with the arc of said top cable facing downstream of said flow of water, said top anchors being positioned on a level slightly higher than the mid-point of said top cable, defining the points between said two top anchors as chord, which has a mid-chord point, the length from said mid-chord point to the mid-point of said top cable as sagitta S, said sagitta S has a length, the upper edge of said sealing wall being attached underneath said top cable; b) providing a flexible reinforcement layer disposed on the downstream side of said sealing wall, at least on the lower portion of the same, said reinforcement layer having upper, lower and side edges, and having means for at least securing said lower edge to the waterbed of said flow of water, and securing said upper edge to an upper reinforcement cable, both ends of said upper reinforcement cable being anchored to a side anchoring means on the banks of said flow of water, said upper reinforcement cable having a positioning means for attaching with said sealing wall; and c) providing at least one reinforcement cable disposed on the downstream side of said reinforcement layer, and between said upper and the lower edges of the same, said at least one reinforcement cable having a positioning means for attaching with said reinforcement layer, the ends of said at least one reinforcement cable being attached to a side anchoring means mounted on both banks of said flow of water.

* * * * *